US006682321B1

(12) United States Patent
Mukherjee et al.

(10) Patent No.: US 6,682,321 B1
(45) Date of Patent: Jan. 27, 2004

(54) THERMALLY DECOUPLED FLANGE FOR MOUNTING TO A TURBINE HOUSING

(75) Inventors: Shankar Mukherjee, Glendale, CA (US); Zandrie J. Wiesma, Redondo Beach, CA (US); Maitreya Madhyastha, Redondo Beach, CA (US); Marion Janik, Rancho Palos Verdes, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/376,048

(22) Filed: Feb. 26, 2003

(51) Int. Cl.[7] ..... F04D 29/58
(52) U.S. Cl. ..... 417/407; 415/178
(58) Field of Search ..... 415/178, 213.1; 417/407

(56) References Cited

U.S. PATENT DOCUMENTS

| | | | | |
|---|---|---|---|---|
| 3,592,564 A | | 7/1971 | Conery | |
| 3,860,359 A | | 1/1975 | De Feo | |
| 4,793,768 A | | 12/1988 | Fairchild et al. | |
| 4,918,917 A | | 4/1990 | Woods | |
| 5,096,377 A | | 3/1992 | Catte et al. | |
| 5,145,334 A | * | 9/1992 | Gutknecht | 417/407 |
| 5,308,169 A | * | 5/1994 | Baker et al. | 417/407 |
| 5,362,204 A | | 11/1994 | Matyscak et al. | |
| 5,403,150 A | * | 4/1995 | McEachern et al. | 415/178 |
| 5,406,795 A | | 4/1995 | Raub et al. | |

FOREIGN PATENT DOCUMENTS

| | | |
|---|---|---|
| JP | 05157098 A | 6/1993 |
| JP | 06317170 A | 11/1994 |
| JP | 07189724 A | 7/1995 |
| JP | 07301199 A | 11/1995 |

* cited by examiner

*Primary Examiner*—Michael Koczo
(74) *Attorney, Agent, or Firm*—Ephraim Starr; Nicholas Gallo

(57) ABSTRACT

A turbocharger including center housing with a thermally decoupling flange is provided. The flange, which extends generally radially outward from a body of the center housing, has a connection portion that can be used to mount the center housing to a turbine housing of the turbocharger. A curved portion of the flange is disposed between the connection portion and the housing body and provides a thermal decouple for reducing the thermal gradient in the connection portion. The curved portion can also increase the flexibility of the flange to reduce the stresses therein that result from temperature variations in the center housing.

20 Claims, 4 Drawing Sheets

THERMALLY DECOUPLED FLANGE FOR MOUNTING TO A TURBINE HOUSING

FIELD OF THE INVENTION

The present invention relates generally to a housing with a mounting flange for connecting the housing to another device and, more particularly, the invention relates to a center housing with a mounting flange for connecting the center housing to a turbine housing of a turbocharger.

BACKGROUND OF THE INVENTION

Turbochargers for gasoline and diesel internal combustion engines are devices known in the art that are used for pressurizing or boosting the intake air stream of the engine by using the flow of hot exhaust gas exiting the engine. The turbocharger typically includes a turbine housing with an inlet that receives exhaust gas exiting the engine such that the exhaust gas spins a turbine in the turbine housing. The turbine is mounted in the turbine housing on a shaft that is common to a radial air compressor housed in a compressor housing. Thus, rotary action of the turbine also causes the air compressor to spin within the compressor housing. The spinning action of the air compressor causes intake air to enter the compressor housing and to be pressurized or boosted a desired amount before it is mixed with fuel and combusted within a combustion chamber of the engine.

The turbine and compressor housings are typically mounted on first and second opposite sides of a center housing. The shaft extends between the turbine and the compressor through a bore in the center housing. An annular area of the first side of the center housing that extends around the shaft can be exposed to the inside of the turbine housing and, hence, the hot exhaust gas passing therethrough. The center housing also has a turbine mounting flange that extends radially outward from the first side of the center housing and is bolted to the turbine housing.

The center housing can define one or more lubricant passages for providing lubricant to the shaft and one or more coolant passages for circulating a coolant fluid such as water. The coolant passage can be an annular passage in the center housing that is proximate to the first side of the center housing and to the turbine housing. As a result of the difference in temperature between the hot exhaust gas in the turbine housing and the relatively cool lubricant and/or coolant fluid in the passages, high thermal gradients result in the center housing causing thermal stresses to develop. Thermal stress can also result from the temperature variations that occur over time during operation of the turbine. For example, the center housing is exposed to thermal transients, or variations, due to changes in the engine exhaust gas temperature over time that occur during normal engine operation. These thermal transients typically result in alternating cycles of heating and cooling of the center housing. During the heating cycles, the center housing can become hot enough to plastically deform, and stresses in the center housing that occur during the cooling cycles can be great enough to cause cracks to form. The likelihood of cracking or other stress damage is often greatest near features in the center housing, such as bolt holes that are provided in the mounting flange. Further, when liquid coolants such as water are circulated through the coolant passage, the higher cooling effect can result in even greater thermal gradients and greater or faster temperature variations in the center housing, thereby increasing the stress in the center housing and increasing the likelihood of cracking.

Cracks that originate in the mounting flange can cause the housing to leak or otherwise fail.

Thus, there exists a need for an improved center housing that is characterized by reduced thermal stresses resulting from temperature variations during heating and cooling and from thermal gradients that exist between the hot exhaust gas and the relatively cooler lubricant and/or cooling fluid. The center housing design should reduce the likelihood of cracking or other failure of the center housing, for example, when cool liquid coolants are circulated through passages in close proximity to the first side of the center housing, which is exposed to the hot gas from the turbine housing.

BRIEF DESCRIPTION OF THE SEVERAL VIEWS OF THE DRAWINGS

Figure 1:
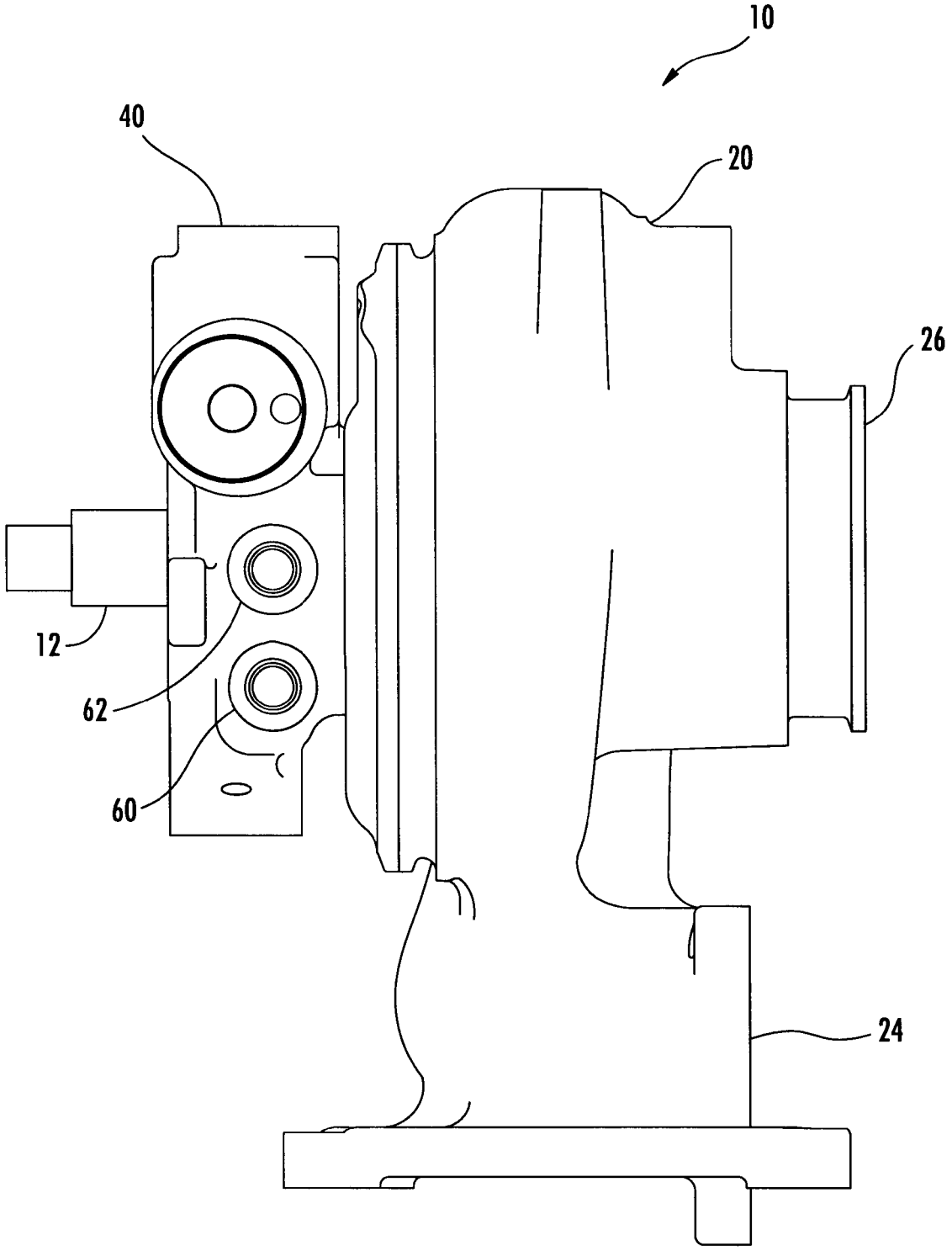
Figure 2:
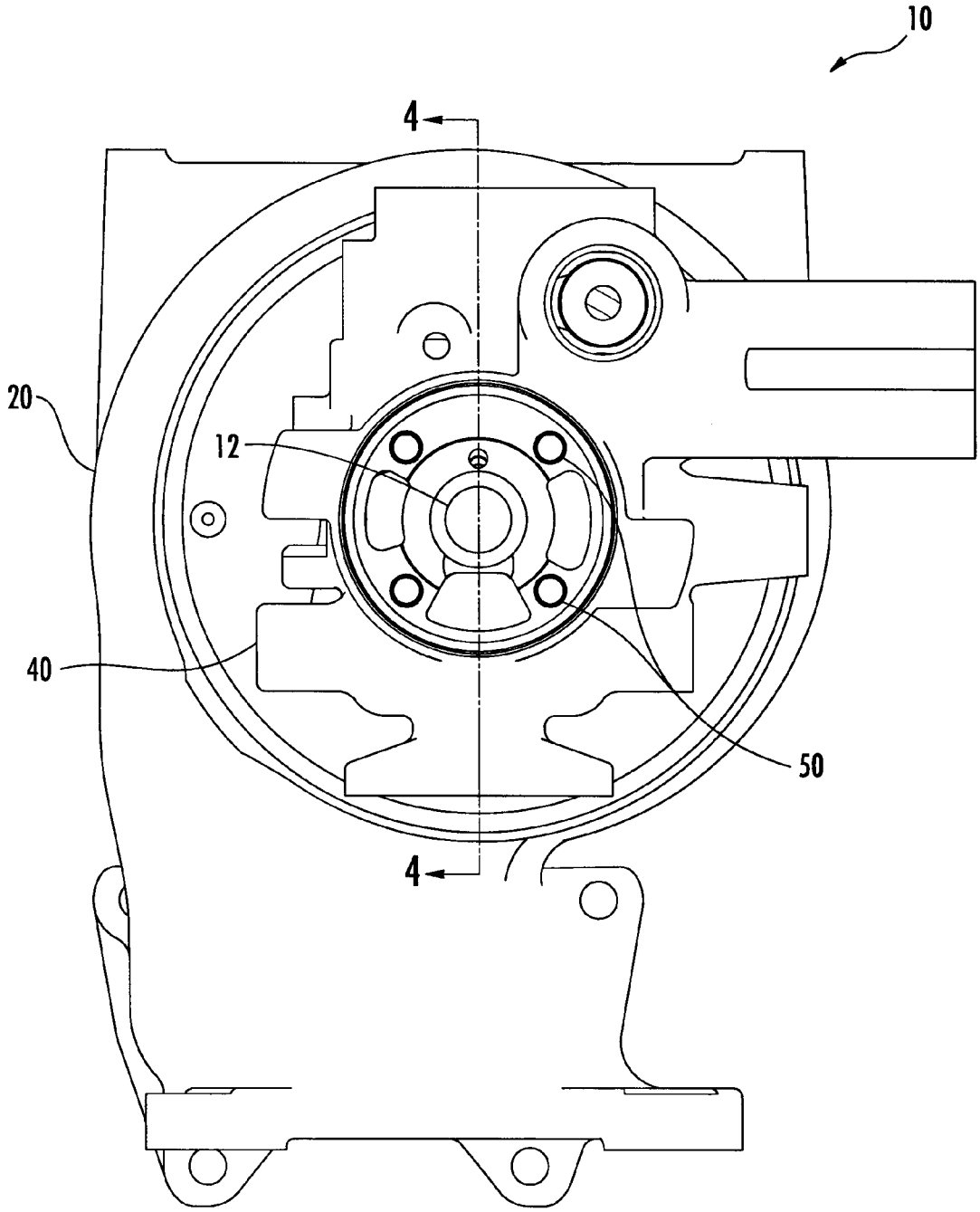
Figure 3:
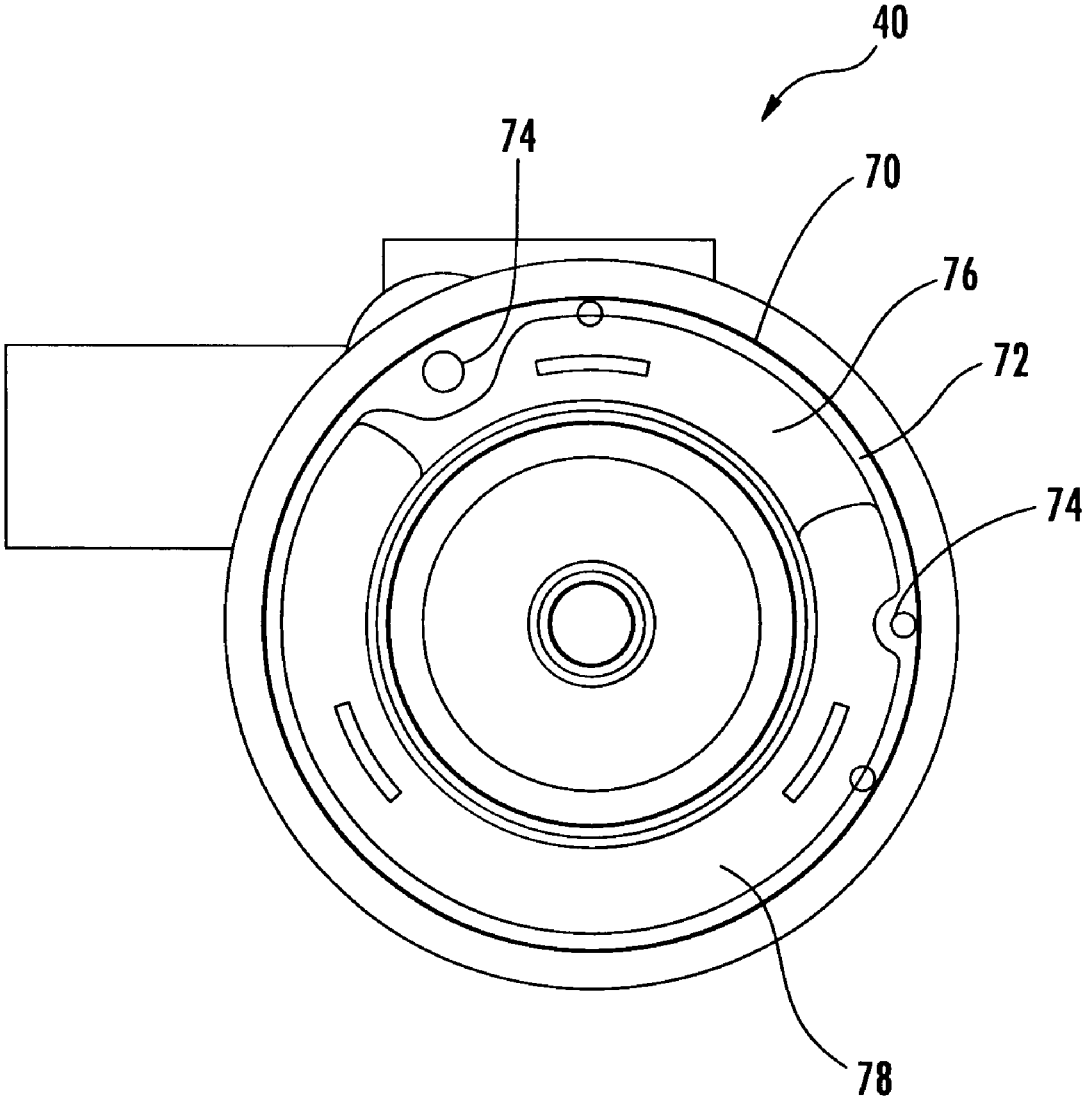
Figure 4:
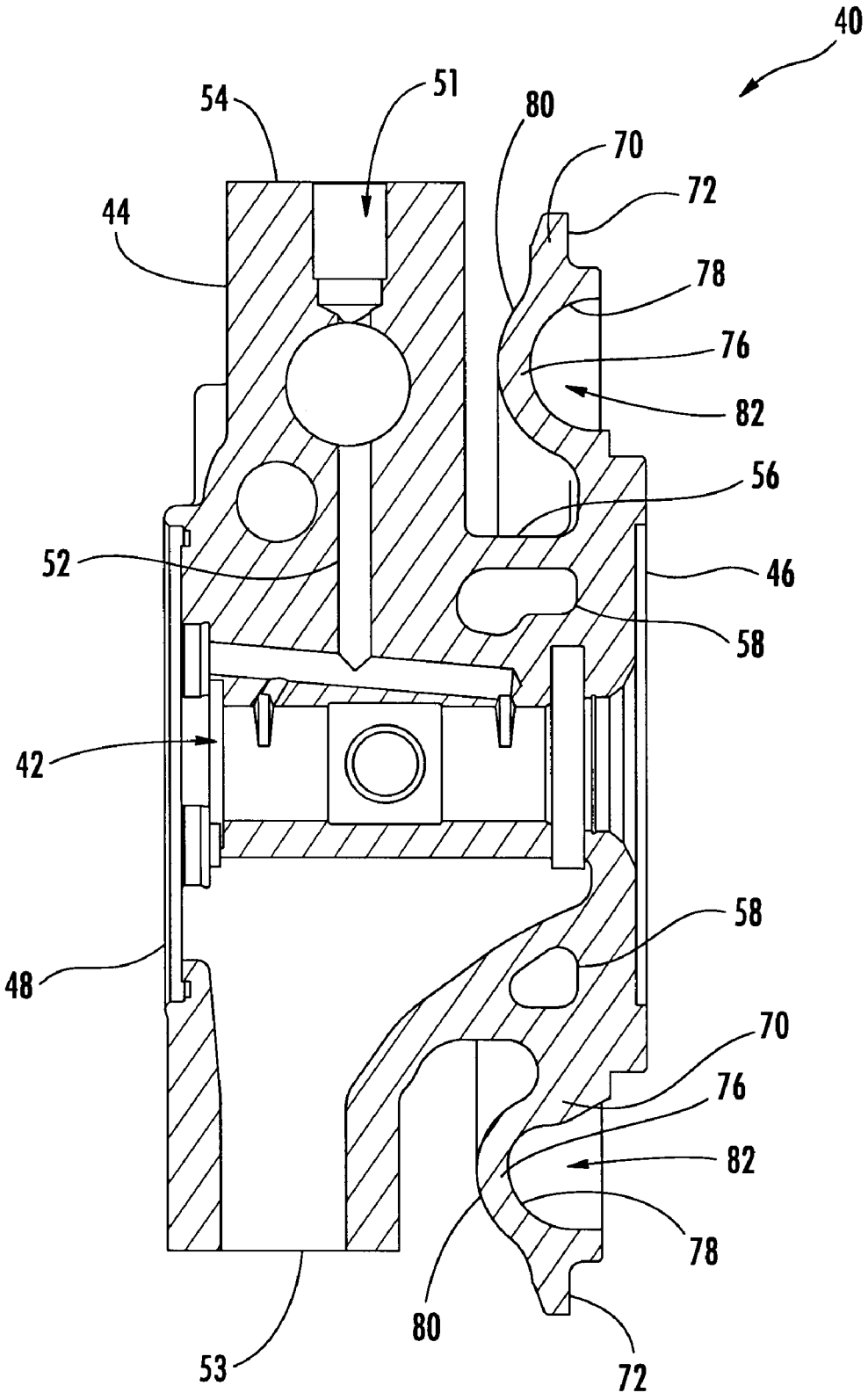

Having thus described the invention in general terms, reference will now be made to the accompanying drawings, which are not necessarily drawn to scale, and wherein:

FIG. 1 is an elevation view illustrating a turbocharger assembly having a turbine housing and center housing according to one embodiment of the present invention;

FIG. 2 is an orthogonal elevation view illustrating the left side of the turbocharger assembly of FIG. 1;

FIG. 3 is an elevation view illustrating the right side of the center housing of the turbocharger assembly of FIG. 1; and FIG. 4 is a section view of the center housing of FIG. 3 as seen along line 4—4 of FIG. 2.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring to FIGS. 1 and 2, there is shown a turbocharger assembly 10 according to one embodiment of the present invention, including a turbine housing 20 and a center housing 40. A first side of the center housing is connected to the turbine housing and a second side of the center housing is configured to be connected to a compressor housing (not shown) for a compressor. A turbocharger formed by connecting a compressor to the assembly 10 can be used in conjunction with a gasoline or diesel internal combustion engine to pressurize the intake air stream of the engine by using the flow of hot exhaust gas exiting the engine. One turbocharger is further described in U.S. Pat. No. 5,947,681 to Rochford, the entirety of which is incorporated herein by reference. The center housing 40 can also be used in other applications, with or without the use of the other components of the turbocharger. Each of the components of the turbocharger assembly 10 can be formed of any of a variety of materials including, but not limited to, cast iron, steel such as stainless steel, aluminum, metal alloys, ceramics, and the like. The components can be formed of the same materials, or each component can be formed of different materials.

As illustrated in FIG. 1, the turbine housing 20 has an inlet 24 for receiving exhaust gas that is exiting the engine. The exhaust gas flows through the turbine housing 20 to an outlet 26, rotating a turbine (not shown), which is rotatably mounted in the turbine housing 20 on a shaft 12. The shaft 12 extends through an aperture in the turbine housing 20, through a shaft bore 42 (FIG. 4) defined by the center housing 40, and into the compressor housing where the shaft 12 engages the compressor. Thus, as the exhaust gas causes the turbine to rotate, the turbine rotates the air compressor via the shaft 12, thereby causing the air compressor to pressurize air that is then mixed with fuel and combusted in the engine.

The center housing 40, shown individually in FIGS. 3 and 4, has a body 44 with first and second sides 46, 48 that are configured to be connected to the turbine housing 20 and compressor housing, respectively. As shown in FIG. 2, connection features 50 such as bolt holes can be provided on the second side 48 of the housing body 44 for connecting the housing body 44 to the compressor housing. The shaft bore 42 extends between the first and second sides 46, 48 and receives the shaft 12 extending between the turbine and the compressor. A lubricant passage 52 extends from an outer surface 54 of the housing body 40 to the shaft bore 42 such that lubricant can be provided to the shaft 12 during operation of the turbocharger. The lubricant passage 52 extends between an inlet 51 and an outlet 53 and can deliver lubricant, for example, to bearings (not shown) that are provided in the bore 42 for supporting the shaft 12 therein. The first side 46 of the housing body 44 is defined by a central block portion 56 of the housing body 44. The central block portion 56 can be generally smaller in diameter than the remaining portion of the housing body 44, i.e., the portion of the housing body 44 that is between the central block portion 56 and the compressor housing.

As shown in FIG. 4, the housing body 44 defines a coolant passage 58 through which coolant fluid can be circulated to control the temperature of the center housing 40. The coolant passage 58, which can be disposed in the central block portion 56 of the housing body 44, extends from an inlet 60 to an outlet 62 (FIG. 1), both of which can be connected to a pump or other device for circulating the fluid, as is known in the art. The coolant can be a gas, such as air. In one advantageous embodiment of the invention, the coolant is a liquid such as water, which is generally capable of absorbing more thermal energy from the center housing 40 than air.

A mounting flange 70 extends in a generally radial direction from the housing body 44, e.g., from the central block portion 56, for mounting or connecting the center housing 40 to the turbine housing 20. The mounting flange 70 can be formed as an integral part of the housing body 44, and the flange 70 can include a connection portion 72 that defines one or more connection features 74 such as bolt holes or pin holes for receiving bolts, pins, or other connection devices that extend into corresponding holes or otherwise engage features in the turbine housing 20. The mounting flange 70 also defines a curved portion 76 that extends circumferentially around at least part of the housing body 44 and is disposed between the housing body 44 and the connection portion 72. At least a portion of the circumference of the flange 70 is curved or c-shaped in cross-section, with the curved portion 76 extending generally radially outward from the housing body 44, and the connection portion 72 extending further radially outward from the curved portion 76. The curved portion 76 of the mounting flange 70 has a generally c-shaped cross-section defined by c-shaped inner and outer surfaces 78, 80, such that the curved portion 76 defines a space 82 between the housing body 44 and the connection portion 72. As illustrated in FIG. 3, the c-shaped curved portion 76 can extend circumferentially around the housing body 44 so that the space 82 is annular around the housing body 44. In other embodiments, the curved portion 76 can extend only partially around the housing body 44 at one or more circumferential positions, for example, so that the curved portion 76 is disposed proximate to holes or other features 74 in the connection portion 72.

The inner surface 78 of the curved portion 76, as well as the first side 46 of the housing body 44, can be exposed to the exhaust gases in the turbine housing 20 through the aperture in the turbine housing 20. Thus, the center housing 40 is contacted and heated by the turbine housing 20 and the exhaust gas, which can reach temperatures of 1450° F. or higher. The center housing 40 is cooled by the coolant fluid circulated through the coolant passage 58, which is typically about 250° F., and by the lubricant. The center housing 40 can also be cooled, though usually to a lesser extent, through convection by air outside the center housing 40. Due to the temperature difference between the hot exhaust gas in the turbine housing 20 and the relatively cool fluid in the coolant passage 58, a spatial thermal gradient exists in the center housing 40. For example, a temperature difference of about 1200° F. can exist in the center housing 40 over a distance of 3 inches or less, though the actual thermal gradient, or temperature difference per unit length, is usually complex, having different values at different locations throughout the center housing 40.

The center housing 40 can be formed of various types of materials. In some cases, the material may have properties enabling it to resist cracking or other failure when subjected to the thermal gradient. However, in other cases the center housing 40 may be formed of a material that is susceptible to cracking when the thermal gradient is coincident with portions of the center housing 40 where stress concentrations are likely to occur, such as bolt holes. For example, the center housing 40 can be formed of cast iron, which can be strong enough to undergo repeated stresses associated with thermal gradients, especially if a large annular flange is provided for connecting the center housing 40 to the to the turbine housing 20. However, the cast iron of the center housing 40 can be susceptible to cracking by the thermal gradients if the gradients are coincident with a bolt hole or other geometric feature that concentrates stress.

The curved portion 76 of the mounting flange 70 at least partially thermally decouples the connection portion 72 of the flange 70 from the housing body 44, i.e., the curved portion 76 at least partially isolates the connection portion 72 from thermal effects in the housing body 44. Thus, although high temperatures may develop in the connection portion 72, the maximum temperature difference, and hence the maximum thermal gradient, in the connection portion 72 of the flange 70 is substantially less than that in the housing body 44. For example, if the temperature difference between the exhaust gas and the coolant fluid is about 1000° F., the temperature difference throughout the connection portion 72 of the flange 70 is typically less than about 100° F., while the temperature difference throughout the housing body 44 can be several times as great. Further, the temperature difference is typically even less in each local area that surrounds the connection features 74 in the connection portion 72. Therefore, the high stresses associated with the thermal gradient are not substantially coincident with the connection features 74 in the connection portion 72 of the flange 70, and the likelihood of failure, such as by cracking near the connection features 74, is reduced. It is understood that some thermal gradient may be present in the connection portion 72 and that the magnitude of the thermal gradient present in the connection portion 72 may vary according to such factors as the shape and dimensions of the housing body 44 and mounting flange 70, the material used to construct the housing body 44 and the mounting flange 70, the location of the coolant passage 58, the temperatures and flow rates of the exhaust gas and coolant fluid, the type of fluid coolant, and others.

The curved portion 76 of the mounting flange 70 also increases the flexibility of the flange 70, which leads to a decrease in the stresses caused by thermal variations throughout the center housing 40. During normal operation of the turbocharger, the center housing 40 can undergo repeated thermal variations, i.e., temperature changes over time. For example, when exhaust gas begins to flow through the turbine housing 20, the turbine housing 20 and the center housing 40 are heated. The temperature of all or part of the center housing 40 can fall, for example, when the temperature of the exhaust gas from the engine decreases, as typically occurs cyclically during normal operation. Such temperature variations can result in thermal expansion or contraction of the center housing 40 and/or thermal stress in the center housing 40. However, because the curved portion 76 of the flange 70 is disposed at least partially outside a radial plane defining the connection portion 72, thermal expansion and contraction of the flange 70 can occur in a non-radial direction, e.g., in an axial direction perpendicular to the plane of the connection portion 72. Thus, the shape and size of the flange 70 can change without corresponding movement of the connection portion 72 of the flange 70, and the resulting stress in the connection portion 72 of the flange 70 is reduced.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A center housing for mounting to a turbine housing, the center housing comprising:

a housing body having a first side, a second side opposed to the first side, and a coolant passage for receiving a coolant fluid; and a mounting flange on the first side, the mounting flange being formed of one piece with the housing body and extending radially from the housing body, the flange having a curved portion and a connection portion, the connection portion configured for connecting the housing body to the turbine housing, wherein the curved portion defines a space between the housing body and the connection portion of the flange.

2. A center housing according to claim 1 wherein the curved portion defines a generally c-shaped cross-section.

3. A center housing according to claim 1 wherein the curved portion extends circumferentially around the housing body such that the curved portion defines an annular space between the housing body and the connection portion of the flange.

4. A center housing according to claim 1 wherein the coolant passage is disposed proximate to the mounting flange.

5. A center housing according to claim 1 wherein the connection portion defines at least one mounting hole for connecting the center housing to the turbine housing.

6. A center housing according to claim 1 wherein the housing body defines a shaft bore for receiving a rotatable shaft extending through the housing body, the mounting flange extending circumferentially around the shaft bore, and wherein the housing body defines a lubricant passage extending from an outer surface of the housing body to the shaft bore.

7. A turbocharger assembly comprising:

a turbine housing defining a gas passage extending from an inlet to an outlet and configured to receive a flow of exhaust gas therethrough, the turbine housing configured to receive a rotatable turbine therein such that the turbine is rotated by the flow of exhaust gas; and a center housing having a housing body defining a first side connected to the turbine housing, a second side opposed to the first side, a shaft bore extending between the first and second sides, and a coolant passage configured to receive a coolant fluid, the second side configured to be connected to a compressor housing having a compressor in rotatable communication with the turbine via a shaft extending through the shaft bore of the housing body, wherein the center housing defines a mounting flange extending generally radially outward from the first side of the housing body, the mounting flange being formed of one piece with the housing body and defining a curved portion and a connection portion, the connection portion configured for mounting the center housing to the turbine housing and the curved portion defining an annular space between the housing body and the connection portion of the flange.

8. A turbocharger assembly according to claim 7 wherein the curved portion of the mounting flange defines a generally c-shaped cross-section.

9. A turbocharger assembly according to claim 7 wherein the turbine housing is connected to the connection portion of the center housing and the turbine housing is directed toward the curved portion of the mounting flange such that at least some of the exhaust gas in the turbine housing contacts the first side of the housing body.

10. A turbocharger assembly according to claim 7 wherein the coolant passage is disposed proximate to the mounting flange.

11. A turbocharger assembly according to claim 7 wherein the connection portion defines at least one connection hole for connecting the center housing to the turbine housing.

12. A turbocharger assembly according to claim 7 wherein the housing body defines a lubricant passage extending from an outer surface of the housing body to the shaft bore.

13. A thermally decoupling flange for mounting a housing body, the mounting flange comprising:

a curved portion being formed of one piece with the housing body and extending radially outward from the housing body;

a connection portion extending radially outward from the curved portion, the connection portion defining at least one connection feature for mounting the housing body, wherein the curved portion defines a space between the housing body and the connection portion of the flange, whereby the curved portion at least partially isolates the connection portion from thermal effects in the housing body.

14. A thermally decoupling flange according to claim 13 wherein the curved portion defines a generally c-shaped cross-section.

15. A thermally decoupling flange according to claim 13 wherein the curved portion extends cirumferentially around the housing body such that the curved portion defines an annular space between the housing body and the connection portion of the flange.

16. A thermally decoupling flange according to claim 13 wherein the at least one connection feature comprises at least one mounting hole for mounting the housing body.

17. A center housing for mounting to a turbine housing, the center housing comprising:

a housing body having a first side, a second side opposed to the first side, and a coolant passage for circulating a coolant fluid; and mounting means for mounting the first side of the housing body to the turbine housing and at least partially thermally decoupling a connection portion of the mounting means from the housing body such that the connection portion is substantially uniform in temperature when a thermal gradient exists between the coolant passage and the connection portion, the mounting means being formed of one piece with the housing body.

18. A center housing according to claim 17 wherein the connection portion defines at least one hole for connecting the center housing to the turbine housing.

19. A center housing according to claim 17 wherein the mounting means is integral to the housing body.

20. A center housing according to claim 17 wherein the housing body defines a shaft bore for receiving a rotatable shaft extending through the housing body, the mounting means extending annularly around the shaft bore.

* * * * *